US006422225B1

(12) United States Patent
Hamer et al.

(10) Patent No.: US 6,422,225 B1
(45) Date of Patent: Jul. 23, 2002

(54) IGNITION COIL AND METHOD OF MAKING

(75) Inventors: Colin Hamer, Carmel; John D. Truong, Mooresville, both of IN (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/977,035

(22) Filed: Oct. 12, 2001

(51) Int. Cl.[7] ..... F02P 11/00
(52) U.S. Cl. ..... 123/634; 123/635
(58) Field of Search ..... 123/634, 635, 123/647; 361/263; 336/105

(56) References Cited

U.S. PATENT DOCUMENTS 4,419,536 A * 12/1983 Doyle et al. ..... 174/52
5,915,367 A * 6/1999 Oishi et al. ..... 123/635
6,055,969 A * 5/2000 Oishi et al. ..... 123/635

* cited by examiner

*Primary Examiner*—Bibhu Mohanty
(74) *Attorney, Agent, or Firm*—Margaret A. Dobrowitsky

(57) ABSTRACT

A suppressor diode for use in an ignition coil, the suppressor diode provides a diode that prevents "make voltages" from breaking down a spark gap of a spark plug. In addition, the resistive inductor prevents electromagnetic interference from the spark plug. The suppressor diode is configured for securement in a confined area of an ignition coil. In particular, the suppressor diode is located between a high-voltage terminal and a high-voltage end of a secondary coil. The suppressor diode includes a spool with a winding surface, a diode is molded into the spool and the diode has a first end connection and a second end connection. The diode is oriented to prevent current flow from the first end connection to the second end connection. A suppressive winding is disposed on to the winding surface, an end cap electrically connects the first end connection of the diode to the suppressor winding. A first termination electrically connects the suppressor winding to a high-voltage end of a secondary winding and a second termination electrically connects the second end of the diode to a high-voltage terminal of the ignition coil.

9 Claims, 4 Drawing Sheets

IGNITION COIL AND METHOD OF MAKING

TECHNICAL FIELD

The present application relates to an ignition coil and method of manufacturing.

BACKGROUND

In recent years, efforts in the automotive industry have been directed to developing ignition coils that are located at each of the spark plugs of an internal combustion engine. Each spark plug therefore has its own ignition coil. A direct connection to the spark plug is preferred because it eliminates the need for high voltage wires from a distributor to each of the spark plugs. Instead, all of the wiring to the spark plugs from the power train control unit (PTCU) of the engine can be provided using inexpensive and compact low-voltage wiring.

Past efforts to provide a direct connection, however, have been complicated because of the limited amount of space at the top of a spark plug in modern engines. The spark plug typically is received in a rather narrow bore hole. Each ignition coil therefore must either fit within the narrow bore hole, or project out therefrom. The option of having the ignition coil project out from the bore hole is typically impractical because it prevents the space above the bore hole from being occupied by other engine components or the vehicle's hood.

As a result, the efforts to provide an ignition coil at each spark plug has resulted in the development of "pencil coils". Pencil coils have an outer diameter that is small enough for the pencil coil to fit within the typical spark plug's bore hole. Even when insertion into a bore hole is not necessary, a reduction in size is desirable because it saves space under the vehicle's hood.

When charging of the coil is initiated, a transient voltage is created. This kind of sparking event is commonly referred to as a spark-on-make event or condition because historically it would occur when the breaker points of the ignition system made contact to commence charging of the ignition coil. The term "spark-on-make", as used in this disclosure however, is not limited to situations where conventional breaker points are used. To the contrary, it refers to any situation where initiation of coil or ignition system charging causes a spark at one or more of the spark plugs. Traditionally, this kind of sparking event is considered undesirable because it was not timed for proper engine operation. In order to control or prevent the make voltage from breaking down the spark gap a diode is employed. As referred to herein "make" voltage defines the voltage induced across the secondary coil when the primary coil is initially energized.

In addition, electromagnetic noise created by the spark event is capable of being received by the high-voltage end of the ignition coil. This electromagnetic noise is undesirable and a suppressor is utilized to reduce the electromagnetic interference of the spark noise.

To be most effective these components (suppressor and diode) should be placed as close as possible to the high-voltage output of the coil. Real estate, however, in a system where both of these devices are needed typically dictates that the suppressor is positioned at the high-voltage side of the coil and a diode is positioned at the low voltage side. This requires two components, both of which are somewhat specialist.

SUMMARY

A suppressor diode for use in an ignition coil, the suppressor diode provides a resistive inductor for preventing "make voltages" from breaking down a spark gap of a spark plug. In addition, the resistive inductor prevents electromagnetic interference from the spark plug. The suppressor diode is configured for securement in a confined area of an ignition coil. In particular, the suppressor diode is located between a high-voltage terminal and a high-voltage end of a secondary coil.

The suppressor diode includes a spool with a winding surface, a diode is molded into the spool and the diode has a first end connection and a second end connection. The diode is oriented to prevent current flow from the first end connection to the second end connection. A suppressive winding is disposed onto the winding surface; an end cap electrically connects the first end connection of the diode to the suppressor winding. A first termination electrically connects the suppressor winding to a high-voltage end of a secondary winding and a second termination electrically connects the second end of the diode to a high-voltage terminal of the ignition coil.

An ignition coil for an internal combustion engine, the ignition coil comprises a primary winding and a secondary winding. The primary winding is adapted to be electrically connected to a low-voltage ignition signal. The secondary winding is inductively coupled to the primary winding with more turns than the primary winding so that the secondary winding develops a high-voltage ignition signal in response to switching of the low-voltage ignition signal. A suppressor diode is located between the high-voltage end of the secondary winding and a high-voltage terminal of the ignition coil. The suppressor diode prevents electromagnetic interference from the spark plug as well as unwanted "make voltages" from appearing at the spark gap.

Still other objects, advantages, and features of the present invention will become more readily apparent when reference is made to the accompanying drawings and the associated description contained herein.

DESCRIPTION OF THE PREFERRED EMBODIMENT

Figure 1:
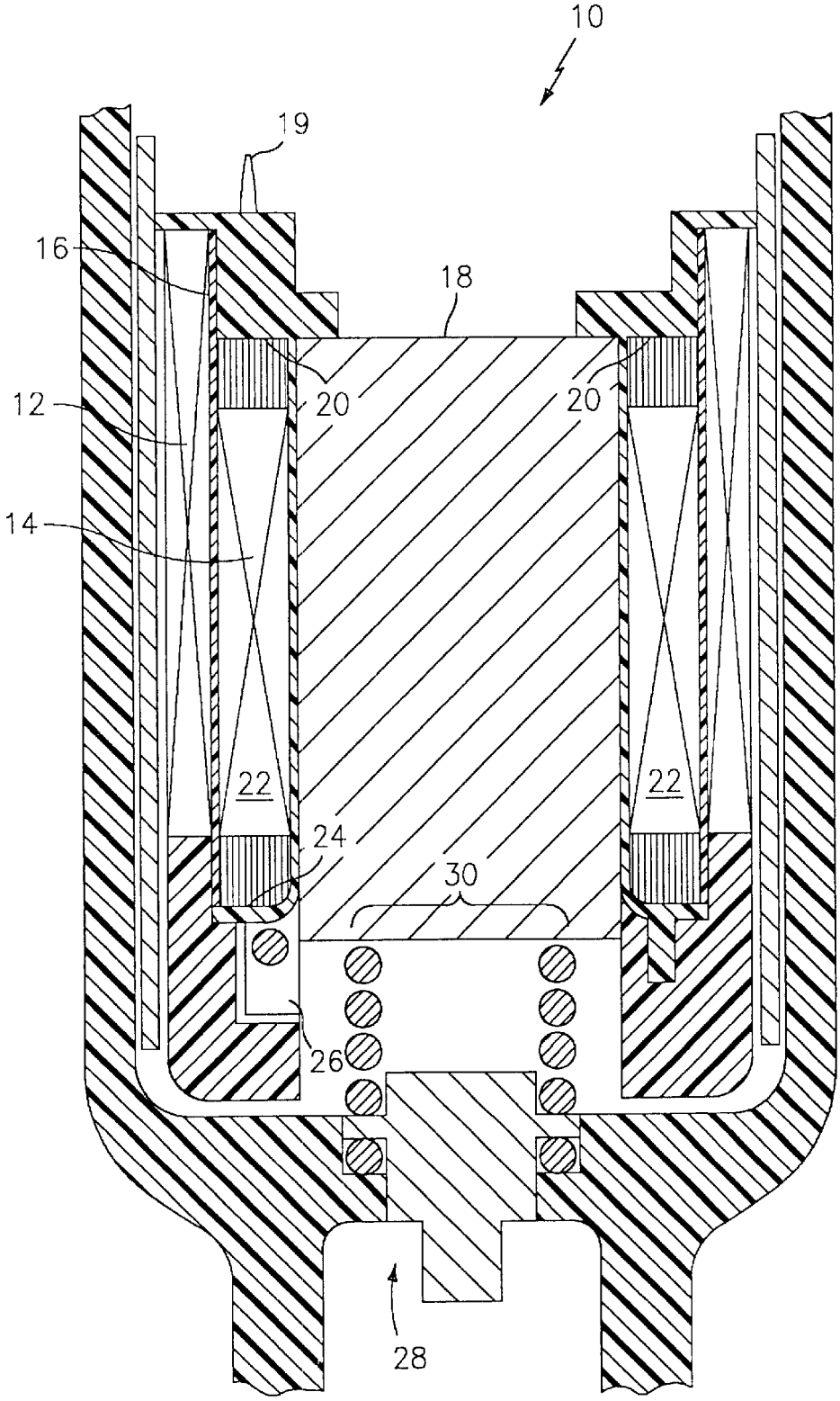
FIG. 1 is cross-sectional view of an ignition coil.

With reference to FIG. 1, an ignition coil 10 includes a primary winding 12 and a secondary winding 14. Both of the windings 12 and 14 circumferentially surround the same magnetic core 18. The magnetic core 18 preferably is made of iron.

The ignition coil 10 can be installed in an automotive vehicle or otherwise to provide sparks in one or more combustion chambers of an internal combustion engine via spark plugs located therein. The automotive implementation of the present invention represents a preferred use upon which the following description will be based. The invention, however, is not limited to such use. To the contrary, the present invention can be used in connection with other implementations of an internal combustion engine.

The primary winding 12 is adapted to be electrically connected to a low-voltage ignition signal. Terminals (not shown), for example, can be electrically connected to respective ends of the primary winding 12. These terminals then can be connected to the low-voltage ignition signal through soldering or any other suitable connection technique.

The secondary winding 14 is inductively coupled to the primary winding 12 with more turns than the primary winding 12 so that any voltage induced across the secondary winding 14 in response to switching of the low-voltage ignition signal causes the secondary winding 14 to develop a high-voltage ignition signal.

The secondary winding 14 is inductively coupled to the primary winding 12 with more turns than the primary winding 12 so that any voltage induced across the secondary winding 14 in response to switching of the low-voltage ignition signal causes the secondary winding 14 to develop a high-voltage ignition signal.

A ground end 16 of the secondary winding 14 preferably is electrically connected to a ground terminal 19 at an end wall 20 of an inner bay 22. The ground terminal provides a convenient way of electrically connecting secondary winding 14 to an electrical ground.

A high-voltage end 24 of secondary winding 14 preferably is electrically connected to a high-voltage terminal 26.

The high-voltage terminal is electrically connected to a spark plug engaging structure 28. Alternatively, the electrical connection between high-voltage end 24 of secondary winding 14 and the spark plug engaging structure 28 can be provided through core 18.

Spark plug engaging structure 28 is adapted to provide an electrical connection between high-voltage end 24 of secondary winding 14 and a central terminal of a spark plug. Spark plug engaging structure 28 preferably includes a resilient device (e.g., spring 30 in FIG. 1) adapted to bias spark plug engaging structure 28 toward a spark plug.

As illustrated, there is a limited amount of space or real estate available for locating components at the high-voltage end of coil 10. For example, and in the case where coil 10 employs a suppressor and a diode there is an insufficient amount of room for placement of both of these items at the high-voltage end of the secondary coil.

Typically, a suppressor for reducing electromagnetic interference is located in the confined area between the point of engagement with respect to the spark plug and the high-voltage terminal of the secondary winding. In this configuration, the diode employed for preventing "make voltage" is located at the other end of the secondary winding where there is additional room. However, locating the diode at this location adversely affects the diode's ability to prevent "make voltages" from passing through the high-voltage end of the secondary winding. Accordingly, and in order for the diode to operate as a full diode it's preferred location is as close as possible to the high-voltage terminal of the ignition coil.

Figure 2:
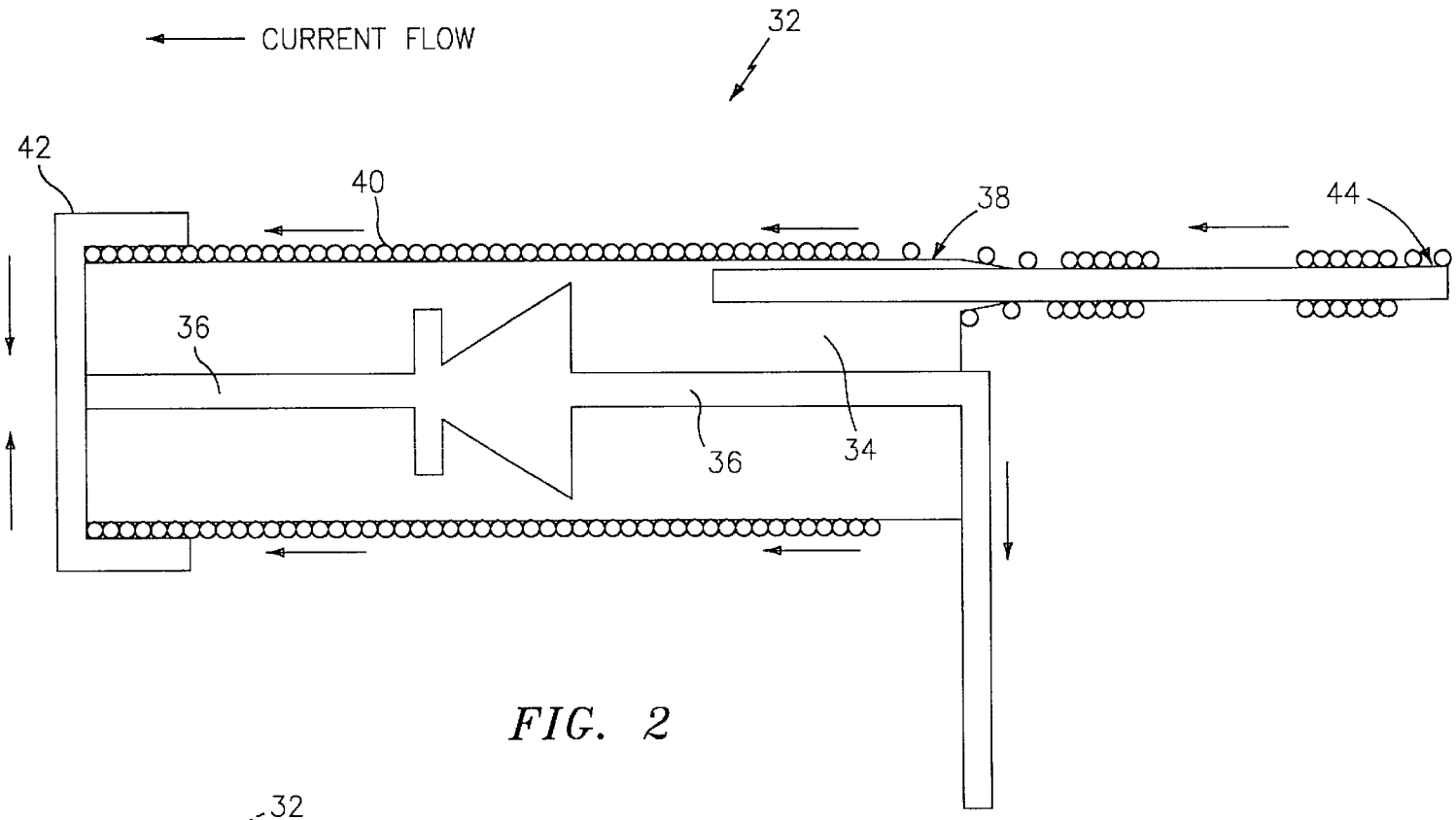
FIG. 2 is cross-sectional view of a suppressor diode constructed in accordance with an exemplary embodiment of the present invention.

Referring now to FIG. 2, a cross-sectional view of a suppressor diode 32 constructed in accordance with an exemplary embodiment of the present invention is illustrated. Suppressor diode 32 is constructed in a manner which allows both the suppressor and the diode to be located in between the high-voltage terminal of the coil and the high-voltage end of the secondary winding thus positioning of devices at the most desirable location.

A terminal 34 parallel to a diode wire 36 is plastic over-molded in place to form a bobbin or spool 38. Alternatively, the diode is pressed or welded into a previously molded bobbin. Bobbin 38 is molded with an external configuration to allow a winding to be wound around the external surface of the Bobbin. In addition, bobbin 38 is molded out of a nonconductive material. A suppressor winding 40 is then wound over the bobbin making electrical connection to the terminal. In accordance with an exemplary embodiment suppressor winding 40 is constructed out of a copper or steel wire having a diameter of approximately 0.6–0.8 mm. In addition, an in accordance with an exemplary embodiment 25–500 turns of wire is necessary for the suppressor winding. The aforementioned dimensions are intended as examples and the present invention is not to be limited by the same.

In addition, and in accordance with an exemplary embodiment of the present invention, an example of the dimensions of the suppressor diode are 2.5 mm in diameter by 4.0 mm in length. The bobbin has dimensions of 4.0 mm in diameter by 10.0 mm in length. Again, these dimensions are provided as an example and the present invention is not intended to be limited to the same.

An end cap 42 is pressed over the suppressor winding making electrical connection at the opposite end. End cap 42 is constructed out of a conductive material. The end cap also makes connection to the diode wire.

This device is then connected to the end of the secondary winding via a termination 44. The end of the diode wire is then connected to the high-voltage output of the ignition coil.

Figure 3:
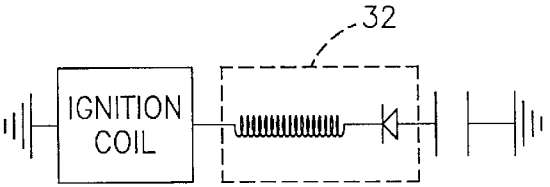
FIG. 3 is a schematic illustration of the FIG. 2 embodiment.

The resulting device is an equivalent diode in series with a resistant inductor. The device is illustrated schematically in FIG. 3. This device is now capable of being inserted into the confined area of the ignition coil in between the high-voltage terminal and the high-voltage end of the secondary winding.

Figure 4:
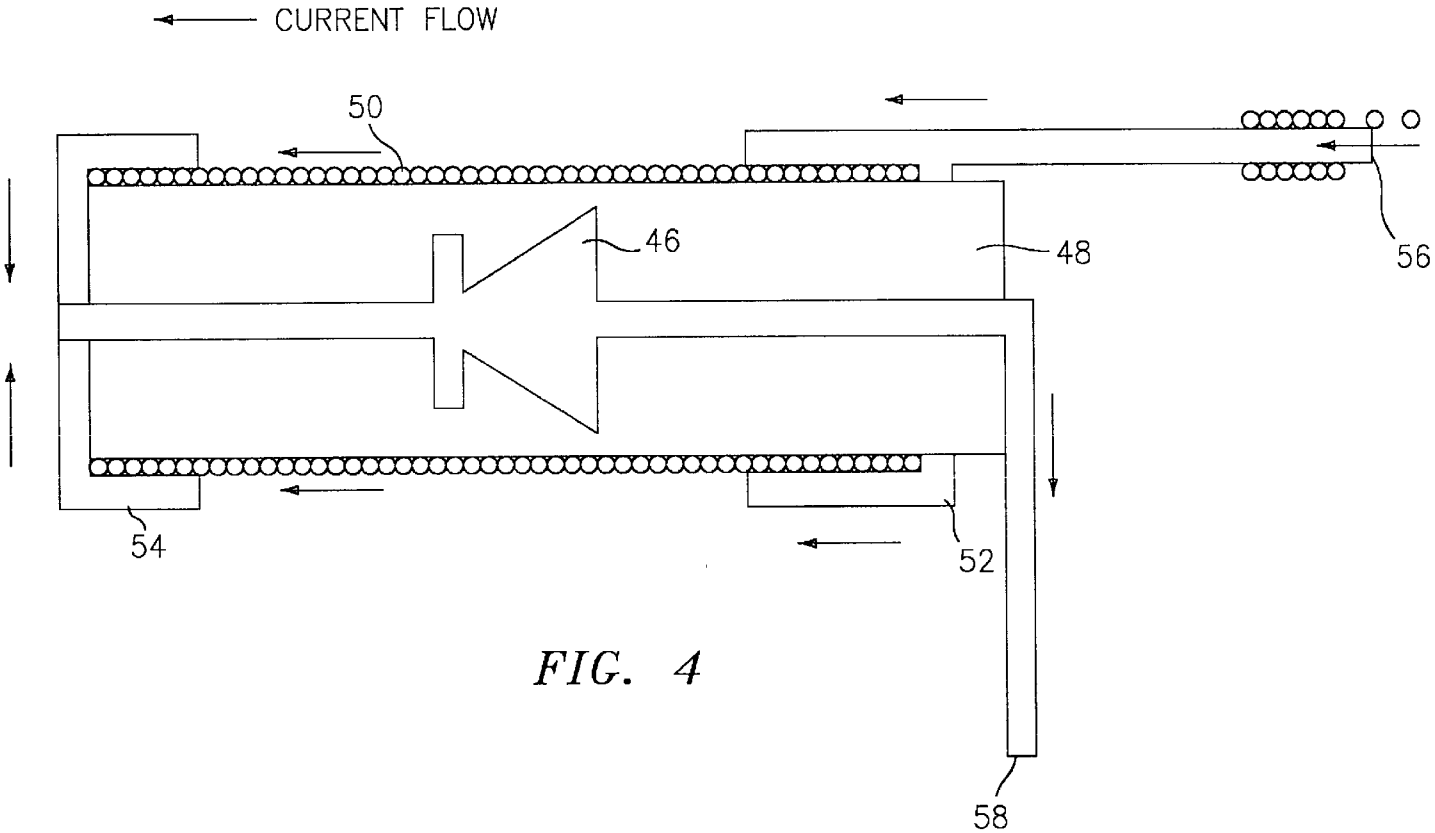
FIG. 4 is cross-sectional view of an alternative embodiment.
Figure 5:
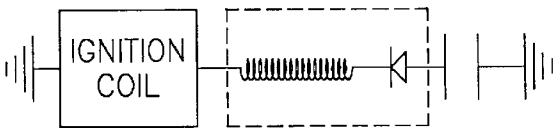
FIG. 5 is a schematic illustration of the FIG. 4 embodiment.

Referring now to FIG. 4 an alternative embodiment is illustrated. Here, a diode 46 is over-molded with plastic to form a bobbin 48. The bobbin is wound to form a suppressor winding 50. An end cap/terminal 52 is pressed onto one end of the suppressor winding and makes an electrical connection. On the opposite end an end cap 54 makes electrical connection to both the suppressor winding and the diode wire. This device is connected to the end of the secondary winding at the end cap/terminal 52 via a secondary winding high-voltage termination 56. The other end of the diode wire is connected to the high-voltage connection of the ignition coil via a termination 58. The resulting device is an equivalent diode and series with a resistant conductor. This device is illustrated schematically in FIG. 5.

Figure 6:
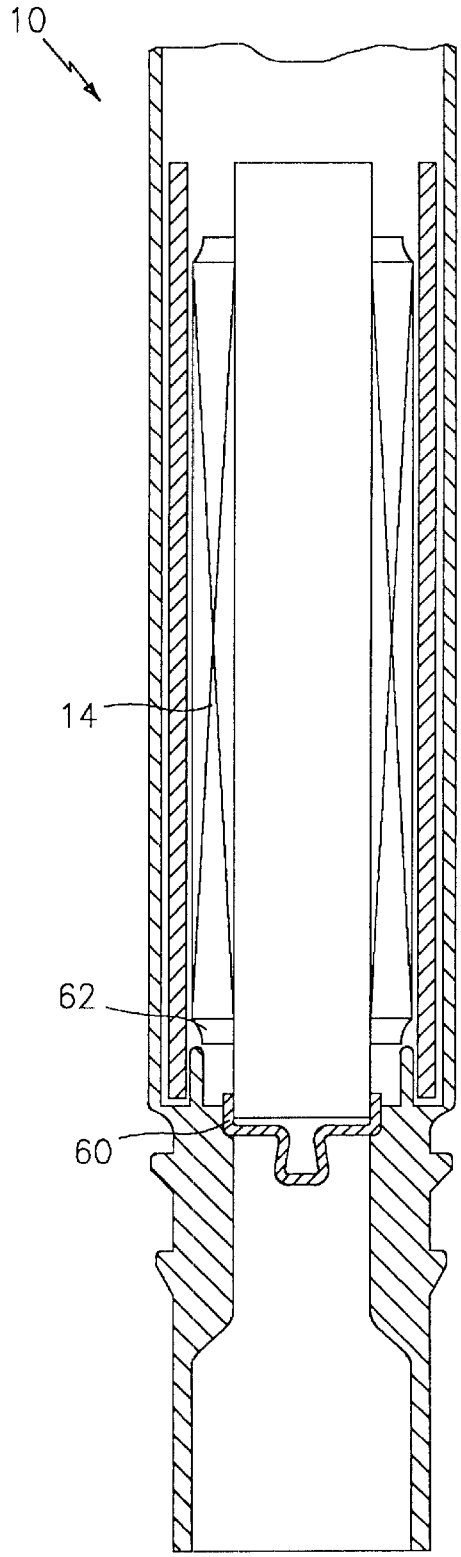
FIG. 6 is a cross-section a view of an ignition coil constructed in accordance with an exemplary embodiment.

Referring now to FIG. 6 a cross-sectional view of a coil 10 constructed in accordance with an exemplary embodiment of the present invention is illustrated. Here device 32 is located between a high-voltage terminal 60 and a high-voltage end 62 of secondary winding 14. Thus, and in accordance with an exemplary embodiment of the present invention a suppressor diode is capable of being positioned in the confined area located between the high-voltage terminal and the high-voltage end of the secondary winding. Accordingly, the desirable features of both the suppressor and the diode are utilized without negatively impacting the operation of the other.

In addition, the coil illustrated in FIG. 6 is configured for insertion into a spark plug bore of an internal combustion engine thus; the need for a compact ignition coil or "pencil coil" as illustrated herein is necessary in order to electrically couple the coil to the receiving end of a spark plug.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A suppressor diode for use in an ignition coil, comprising:

a spool having a winding surface;

a diode being molded into said spool, said diode having a first end connection and a second end connection, said diode being oriented to prevent current flow from said first end connection to said second end connection;

a suppressive winding being wound onto said winding surface;

an end cap electrically connecting said first end connection of said diode to said suppressor winding;

a first termination electrically connecting said suppressor winding to a high-voltage end of a secondary winding; and a second termination electrically connecting said second end of said diode to a high-voltage terminal of the ignition coil.

2. The suppressor diode as in claim 1, wherein said diode is pressed into said spool.

3. The suppressor diode as in claim 1, wherein said diode is welded to said spool.

4. A suppressor diode for use in an ignition coil, comprising:

a spool having a winding surface;

a diode being molded into said spool, said diode having a first end connection and a second end connection, said diode being oriented to prevent current flow from said first end connection to said second end connection;

a suppressive winding being wound onto said winding surface;

a first end cap electrically connecting said first end connection of said diode to said suppressor winding;

a second end cap providing a first termination electrically connecting said suppressor winding to a high-voltage end of said secondary winding; and a second termination electrically connecting said second end of said diode to a high-voltage terminal of the ignition coil.

5. An ignition coil for an internal combustion engine, comprising:

a primary winding adapted to be electrically connected to a low-voltage ignition signal;

a secondary winding inductively coupled to said primary winding with more turns than said primary winding so that said secondary winding develops a high-voltage ignition signal in response to switching of said low-voltage ignition signal; and a suppressor diode being configured to connect a high-voltage end of said secondary winding to a high-voltage terminal of said ignition coil, said suppressor diode comprising:

a spool having a winding surface;

a diode being molded into said spool, said diode having a first end connection and a second end connection, said diode being oriented to prevent current flow from said first end connection to said second end connection;

a suppressive winding being wound onto said winding surface;

an end cap electrically connecting said first end connection of said diode to said suppressor winding;

a first termination electrically connecting said suppressor winding to said high-voltage end of said secondary winding; and a second termination electrically connecting said second end of said diode to said high-voltage terminal of the ignition coil.

6. The ignition coil as in claim 5, for the comprising:

an end cap configured to support said first termination, said end cap electrically connecting said suppressive winding to said first termination.

7. The ignition coil as in claim 5, wherein said ignition coil is configured to have a portion inserted within a spark plug bore of an internal combustion engine.

8. The ignition coil as in claim 7, wherein said portion includes the suppressor diode.

9. A method of manufacturing a suppressive diode for use with an ignition coil having a primary winding and a secondary winding, comprising:

molding a diode within a bobbin having a winding surface, said diode having a first end and a second end, said diode being configured to prevent current flow from said first end to said second end;

winding a suppressor winding onto said winding surface;

electrically connecting said first end of said diode to a first portion of said suppressor winding;

electrically connecting said second end of said diode to the high-voltage terminal of said ignition coil; and electrically terminating a second portion of said suppressor winding to a high-voltage end of the secondary winding.

* * * * *